US007395619B2

(12) United States Patent
Lee

(10) Patent No.: US 7,395,619 B2
(45) Date of Patent: Jul. 8, 2008

(54) STEAM IRON

(75) Inventor: Pak Man Lee, Shenzhen (CN)

(73) Assignee: Tunbow Electrical Limited, Hong Kong (CN)

( * ) Notice: Subject to any disclaimer, the term of this patent is extended or adjusted under 35 U.S.C. 154(b) by 177 days.

(21) Appl. No.: 11/341,131

(22) Filed: Jan. 27, 2006

(65) Prior Publication Data

US 2007/0175072 A1 Aug. 2, 2007

(51) Int. Cl.
*D06F 75/18* (2006.01)
*D06F 75/06* (2006.01)

(52) U.S. Cl. ..... 38/77.8

(58) Field of Classification Search ..... 38/77.1, 38/77.7, 7.83, 77.8, 93; 219/245, 248, 254
See application file for complete search history.

(56) References Cited

U.S. PATENT DOCUMENTS 2,770,896 A * 11/1956 Holmberg ..... 38/77.1
4,837,952 A * 6/1989 Hennuy et al. ..... 38/77.7
5,010,664 A * 4/1991 Sakano et al. ..... 38/77.7
5,042,179 A * 8/1991 van der Meer ..... 38/77.83
5,642,578 A * 7/1997 Hazan et al. ..... 38/77.7
5,642,579 A * 7/1997 Netten et al. ..... 38/77.7
6,178,671 B1 * 1/2001 Zwanenburg et al. ..... 38/77.8

FOREIGN PATENT DOCUMENTS

JP 405076700 A * 3/1993

* cited by examiner

*Primary Examiner*—Ismael Izaguirre
(74) *Attorney, Agent, or Firm*—Marshall, Gerstein & Borun LLP

(57) ABSTRACT

A steam iron (10) for clothing has direct measurement of sole plate temperature by a suitable sensor (19). A control device (20) such as a programmable logic controller, holds a characteristic relating sole plate temperature to steam production, and controls opening of an electrically actuated release valve (16) for water from a tank (15) to the sole plate (13). The sensor (19) may also control electrical energy for heating the sole plate (13).

11 Claims, 2 Drawing Sheets

Fig 2
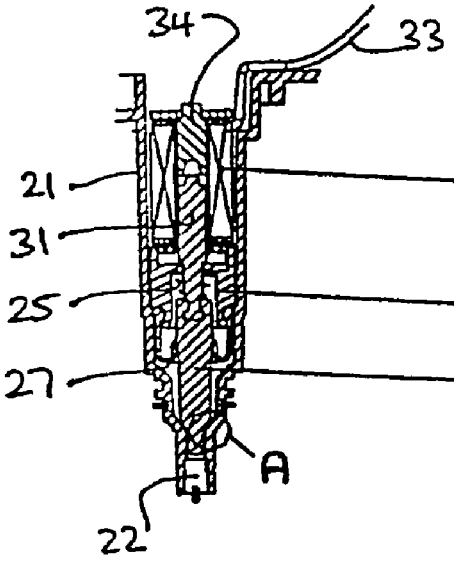
Fig 3
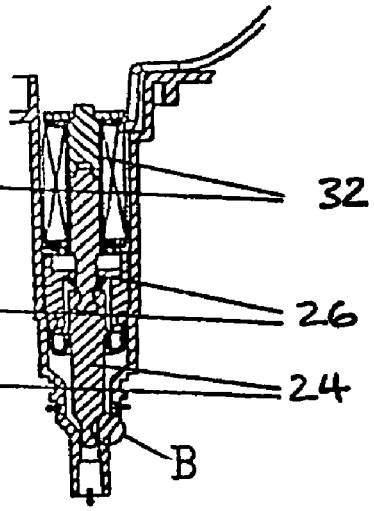
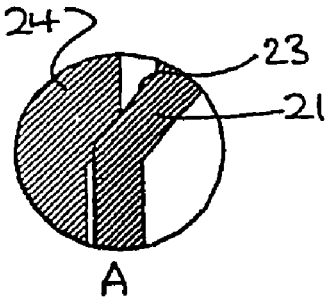
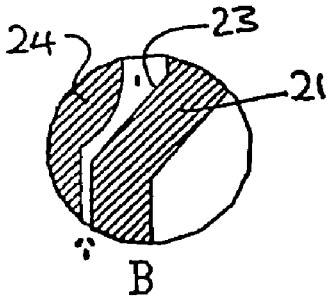
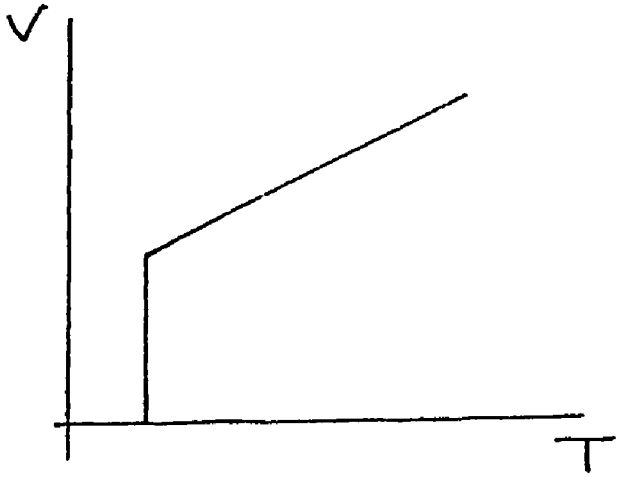
Fig 4

STEAM IRON

TECHNICAL FIELD

This invention relates to improvements in steam irons for clothing.

BACKGROUND TO THE INVENTION

Irons for clothing have a heated sole plate with which a user may smooth out unwanted clothing creases, and reinforce or create desired creases. Heating energy is usually provided by a thermostatically controlled electric element, and the temperature of the sole plate is typically selected by the user to suit the nature of the clothing to be ironed. The user may lightly damp the clothing, in order to better eliminate unwanted creases.

In a refinement an iron may be provided with a water tank, and a valve assembly whereby water can be admitted from the tank to outlets of the heated sole plate where it vaporises, and issues as steam. This arrangement avoids the need for damping of clothing and can give a superior and faster ironing action.

In one known arrangement a progressive slide valve is provided whereby water is continually passed through the sole plate to give a substantially constant steaming effect. The slide valve typically has a variable opening so as to permit the volume of stream to be selected. In another arrangement a manual pump is provided whereby the use may force some water through the sole plate to give a single burst of steam. Both of these arrangements are often provided in clothing irons.

One known problem of steam irons is the phenomenon of dripping, in which unvaporised water escapes from the sole plate onto the clothing. Such dripping is usually caused by an inappropriate relationship between the temperature of the sole plate and the volume of water admitted via the slide valve, so that there is insufficient heat capacity to vaporise all of the water passing through the soleplate. Dripping may also be caused by inevitable hysteresis exhibited by the sole plate thermostat, so that as the temperature of the sole plate falls to a minimum, some water droplets escape. At higher sole plate temperature, such droplets are vaporised.

In order to solve the dripping problem it has been proposed to incorporate a closure valve actuated by a bi-metallic control element in the water supply passage to the sole plate. As is well known, the degree of curvature of such a control element can change appreciably on heating, and can be used to move the closure valve so as to block and unblock water flow. Thus water flow may be inhibited below a predetermined minimum sole plate temperature, so that dripping is largely prevented.

However, the prior art solutions do not entirely solve the problem of dripping. Furthermore such bi-metallic control elements may exhibit an undesirable clicking sound during operation.

What is required is an improved means of relating water flow and hence potential steam generation, to sole plate temperature. The elimination of bi-metallic control elements would be advantageous in order to avoid unwanted hysteresis, and variability due to manufacturing and assembly inconsistences.

SUMMARY OF THE INVENTION

According to a first aspect of the invention there is provided a steam iron for clothing, said iron comprising a body, a water tank in said body, a heatable sole plate having an interior side and an exterior side, through passages from said interior side to said exterior side, and a control device operable to release water from source tank to said interior side, wherein a temperature sensor having an electrical output is provided on said sole plate, and said control device is electrically operable in response to said output.

Such an iron provides for admission of water to the sole plate in a highly controllable manner, since the electrically operable control device is operable directly in accordance with sole plate temperature The sensor provides continuous temperature monitoring and a proportionate electrical output which varies in real time according to sole plate temperature.

In one preferred embodiment, the control device comprises a digital (on/off) device, and in another embodiment the volume throughput of the control device is proportioned to the temperature of the sole plate.

The control device may for example be an electrical solenoid valve having an armature movable in response to an electrical control signal to open a valve element.

In a further embodiment, the iron may include a programmable device adapted to retain a predetermined characteristic relating volume throughput of the control device to temperature of the sole plate. Such a characteristic may be non-linear, and incorporate a temperature threshold below which the control device is closed. The programmable device may comprise a programmable read only memory (ROM).

Since the invention gives close control of water volume in accordance with sole plate temperature, it will be appreciated that steam volume can be maximised for any particular sole plate temperature. Ironing is thus more effective without the risk of dripping. Other features of the apparatus will be apparent from the following description and the claims appended hereto.

According to a second aspect of the invention there is provided a method of controlling release of water from the water tank to the sole plate of a steam iron for clothing, said method comprising the steps of:

determining the temperature of said sole plate by means of a sensor having a proportionate electrical output;

controlling release of water via an electrically actuable device operable in accordance with said output. The method permits accurate release of water in accordance with actual sole plate temperature, and thus avoids dripping. Other features of the method will be apparent from the following description and the claims appended thereto.

BRIEF DESCRIPTION OF DRAWINGS

Other features of the invention will be apparent from the following description of a preferred embodiment shown by way of example only in the accompanying drawings in which:

FIG. 2 illustrates in axial section a solenoid valve of the invention in the inactive (closed) condition;

FIG. 3 corresponds to FIG. 2 and shows the solenoid valve in the active (working) condition.

FIG. 4 shows a typical temperature/volume control coefficient.

DESCRIPTION OF PREFERRED EMBODIMENT

Figure 1:
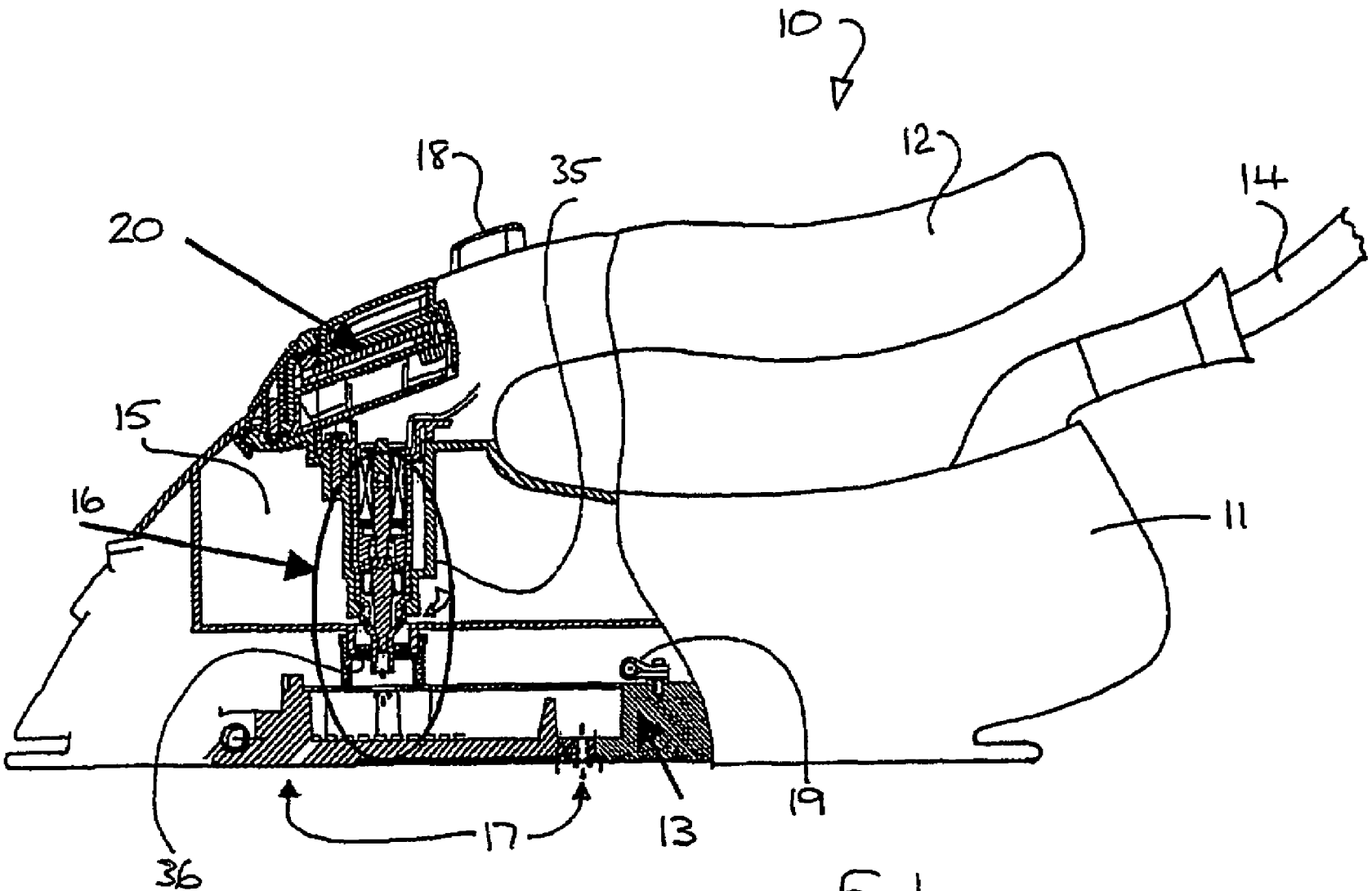
FIG. 1 is a partial sectional view of the nose of a steaming iron incorporating the present invention.

With reference to FIG. 1, a domestic steam iron 10 comprises a main body 11 having a handle 12 above and a metal sole plate 13 below. The sole plate 13 incorporates an electric heating element for which power is supplied by a flexible cable 14. Within the main body 11 is provided a water tank 15 having a suitable filling aperture (not shown). A valve 16, to be described in greater detail below, is operable to admit water by gravity from the tank 15, to the interior side of the sole plate 13, which has an array of through apertures 17 therein.

As is well known, the sole plate is in use heated, and water admitted via the valve 16 is vaporised so as to issue from the apertures 17 as steam.

The sole plate 13 is generally triangular in plan and has a pointed nose to facilitate ironing. The main body may be of any suitable material, and is typically moulded of plastics. An adjustable thermostat (not shown) is provided whereby the user can select an appropriate sole plate temperature. A pump button 18 is provided whereby thumb actuation causes a small volume of water to be admitted to the sole plate to give a burst of steam on demand.

The steam iron of the invention incorporates a temperature sensor 19 fixed to the interior side of the sole plate. In the preferred embodiment a negative temperature coefficient (NTC) sensor is used, though other kinds of sensor may be suitable. Furthermore, the handle 12 incorporates a printed circuit board 20 (such as a programmable logic controller—PLC) which is pre-programmed to provide in use control of steaming in the manner now described.

FIGS. 2 and 3 illustrate a solenoid operated valve for controlling admission of water from the water tank 15 to the interior of the sole plate 13.

The solenoid valve 16 is rotationally symmetrical about the upright axis thereof, and comprises a tubular body 21 which has an axial opening 22 at the lower end, and defines just above the opening a frusto-conical internal seat 23. A cylindrical valve member 24 within the body 21 includes an annulus adapted to seal against the seat 23 and thereby close the opening 22, as illustrated in enlarged portion A. The valve member is preferably of relatively soft material, such as a silicon rubber, in order to ensure effective sealing at the seat 23.

The member 24 is urged downwardly to the closed condition by a light coil spring 25 which reacts against an annular abutment 26 fixed within the body 21 at mid-height. An annular flexible boot 27 seals the valve member 24 to the abutment 26 and body 21, as illustrated, so as to permit axial movement of the member 24 whilst preventing escape of water in the upward direction.

As will be appreciated, the annular volume above the valve seat 23 and below the boot 27 is in communication with the interior of the water tank, for example via one or more apertures in the wall of the body 21.

A solenoid armature 31 is connected to the valve member 24, and extends generally vertically through a fixed solenoid coil 32 housed within the upper region of the tubular body 21. The coil 32 is connected to a source of electrical energy via a cable 33. A plug 34 closes the upper opening in the coil 32 and permits limited upward movement of the armature 31 from the inactive condition illustrated in FIG. 2.

The valve 16 is housed within a chamber 35 of the water tank, and in use is inserted from above and sealed at the bottom by an annular grommet 36. The valve is retained in place by any suitable fastening means.

On activation of the solenoid coil 32, the armature is attracted upwardly by the electrical field into contact with the plug 34, and the valve member opens the seat 23 as illustrated in FIG. 3 (and enlarged portion B). The size of the opening is strictly controlled by positioning of the plug 34, which may be settable by e.g. screw-threading. When inactivated, the electrical field generated by the coil 32 ceases, and the spring 25 returns the valve member 24 to the seated condition (FIG. 2).

The temperature sensor 19 and solenoid coil 32 are connected to the circuit board 20, which is itself powered via the cable 14. The sensor 19 directly and continuously monitors actual temperature of the sole plate, for example by outputting a voltage output proportional to temperature. Hysteresis of an NTC sensor, if any, is minimal. The circuit board 20 is pre-programmed to activate the solenoid coil to release water via the opening 22 according to sole plate temperature, thus ensuring that the optimum volume of steam is produced without risk of water droplets.

A typical control coefficient for the circuit board 20 is illustrated in FIG. 4. Thus no water is admitted via the solenoid valve 16 until the sole plate reaches a minimum temperature. At the minimum temperature, a predetermined volumetric flow is permitted by opening of the valve 16, which increases progressively as sole plate temperature further increases.

Other control coefficients are of course possible, and water supply may be switchable on or off according to a separate control switch on the iron body. Opening of the solenoid valve may be progressive, or the solenoid valve may reciprocate at a variable rate determined at the circuit board 20. In the latter case the volume of steam depends on the frequency and period of solenoid activation.

In this embodiment solenoid control of the valve 16 is the means of admitting the correct flow rate of water to the sole plate. In the alternative, any suitable electrically actuated device may be used, such as another form of electrically operated valve, or an electrically driven pump.

A further embodiment of the direct temperature sensor 19 is that the output may be used to directly replace the usual bi-metallic thermostat of the sole plate heating element. Thus a more accurate control of actual sole plate temperature can be assured, typically within a small hysteresis range determined by pre-programming features of the PCB 20.

The invention claimed is:

1. A steam iron for clothing, said iron comprising:

a body;

a water tank in said body;

a heatable sole plate having an interior side, an exterior side, and through passages from said interior side to said exterior side;

a temperature sensor provided on said sole plate and having an electrical output; and a control device operable to release water from said tank to said interior side, the control device comprises a solenoid operated release valve, the release valve comprising:

a tubular body defining an internal frustoconical valve seat a valve element movable to and from the valve seat, the valve element comprising a cylindrical armature having a frusto conical seating land for engagement with said seat; and a resilient bias to urge said valve element to said valve seat, wherein said control device is electrically operable in response to said electrical output of said temperature sensor such that said solenoid is activated by said electrical output to move said valve element from said seat against said resilient bias.

2. An iron according to claim 1 wherein said sensor has an output proportional to the temperature of said sole plate.

3. An iron according to claim 2 and further including a programmable device adapted to retain a predetermined characteristic relating to output of said sensor to the throughput of said control device, and to activate said control device in accordance with said characteristic.

4. An iron according to claim 1 wherein said armature comprises an elastomeric seating land, and said tubular body defines a relatively hard valve seat.

5. An iron according to claim 1 wherein said release valve is substantially within said water tank.

6. An iron according to claim 5 wherein said water tank lies above said sole plate and comprise an internal chamber, said release valve being insertable into said chamber from above, and having an outlet opening over said sole plate.

7. An iron according to claim 1 wherein said sensor comprises a negative temperature coefficient (NTC) sensor.

8. An iron according to claim 7 wherein said sensor is attached to the interior side of said sole plate.

9. A method of controlling the release of water from a water tank to a sole plate of a steam iron, said method comprising:

determining the temperature of said sole plate by means of a sensor having a proportionate electrical output;

providing a pre-programmable characteristic relating the temperature of said sole plate to a desired flow rate of water; and controlling release of water via an electrically actuable device operable in accordance with said characteristic.

10. A method according to claim 9 wherein said characteristic includes a temperature threshold below which operation of said electrically actuable device is inhibited.

11. A method according to claim 9 wherein the output of said temperature sensor is further utilized in controlling heating of said sole plate by sequentially switching on and off an electrical heating supply of said sole plate, the switching on temperature being less than the switching off temperature.

* * * * *

UNITED STATES PATENT AND TRADEMARK OFFICE

CERTIFICATE OF CORRECTION

PATENT NO. : 7,395,619 B2
APPLICATION NO. : 11/341131
DATED : July 8, 2008
INVENTOR(S) : Pak M. Lee It is certified that error appears in the above-identified patent and that said Letters Patent is hereby corrected as shown below:

On the Title Page:

Item (73), "Hong Kong" should be -- Kowloon --.

At Column 5, line 12, "comprise" should be -- comprises --.

Signed and Sealed this

Eighteenth Day of November, 2008

JON W. DUDAS
*Director of the United States Patent and Trademark Office*